US007004103B2

(12) United States Patent
Chen

(10) Patent No.: US 7,004,103 B2
(45) Date of Patent: Feb. 28, 2006

(54) ANTENNA FOB

(75) Inventor: An-Chi Chen, Taipei (TW)

(73) Assignee: Rocking P Inc., St. Clair, MO (US)

( * ) Notice: Subject to any disclaimer, the term of this patent is extended or adjusted under 35 U.S.C. 154(b) by 0 days.

(21) Appl. No.: 10/306,334

(22) Filed: Nov. 27, 2002

(65) Prior Publication Data

US 2004/0099201 A1 May 27, 2004

(51) Int. Cl.
*G01F 21/04* (2006.01)

(52) U.S. Cl. ..... 116/28 R; 116/173; 116/209; 40/591; 403/278

(58) Field of Classification Search ..... 116/28 R, 116/209, 173, 174; 248/288.31, 181.1, 181.2; 40/591, 592; 403/277, 278, 279, 281
See application file for complete search history.

(56) References Cited

U.S. PATENT DOCUMENTS

| | | | | | |
|---|---|---|---|---|---|
| 2,329,046 | A | | 9/1943 | Halbig | |
| 3,104,644 | A | | 9/1963 | Burton | |
| 3,172,220 | A | | 3/1965 | Christensen | |
| 3,604,290 | A | * | 9/1971 | Waite | 81/3.4 |
| 3,636,912 | A | | 1/1972 | Kamp | |
| 3,929,310 | A | | 12/1975 | Peham | |
| 3,948,210 | A | | 4/1976 | Van Rijn | |
| 4,702,129 | A | * | 10/1987 | Allen | 81/3.09 |
| 4,972,795 | A | * | 11/1990 | Mace | 116/28 R |
| 4,978,964 | A | | 12/1990 | Castille | |
| 5,078,075 | A | * | 1/1992 | Liming et al. | 116/173 |
| 5,156,110 | A | | 10/1992 | Fuller | |
| 5,451,045 | A | | 9/1995 | Garske | |
| 5,572,225 | A | | 11/1996 | McCarthy | |
| 5,590,621 | A | | 1/1997 | Sectish | |
| 5,620,277 | A | | 4/1997 | Cole, Sr. et al. | |
| D381,367 | S | | 7/1997 | Rashman | |
| D387,772 | S | | 12/1997 | Steinberg | |
| 5,836,261 | A | | 11/1998 | Sutton | |
| 5,881,667 | A | * | 3/1999 | Herbert | 116/209 |
| 6,106,912 | A | | 8/2000 | Balog | |
| 6,197,390 | B1 | | 3/2001 | LaVite | |
| 6,247,423 | B1 | * | 6/2001 | Ingram et al. | 116/28 R |
| 2003/0019139 | A1 | * | 1/2003 | Cook | 40/591 |
| 2004/0035352 | A1 | * | 2/2004 | Self et al. | 116/28 R |

* cited by examiner

*Primary Examiner*—Diego Gutierrez
*Assistant Examiner*—Tania Courson
(74) *Attorney, Agent, or Firm*—Thompson Coburn LLP

(57) ABSTRACT

An antenna fob is disclosed that comprises a main body portion and a socket. The socket extends into the main body portion and reduces in size as it does so and is configured and adapted to allow the free end of a vehicle's antenna to be inserted thereinto. An antenna assembly fob assembly is also disclosed which comprises a hollow exterior body portion and an antenna attachment member. The antenna attachment member and the exterior body portion are secured to each other via interlocking geometry of a rim of the attachment member and a channel of the exterior body portion.

17 Claims, 3 Drawing Sheets

ANTENNA FOB

BACKGROUND OF THE INVENTION

Antenna fobs of various types are well known in the prior art. Typically, vehicle owners or drivers attach antenna fobs to their vehicles antennas so as to display loyalty to a particular sports team, interest in a particular hobby, association with a particular group of individuals, advertisements, or merely an object in a whimsical manner. As such, antenna fobs are frequently shaped in a manner to symbolize a particular object or creature.

An antenna fob is typically attached to the upper most, free end of a vehicle's antenna. In some cases, an antenna fob may comprise a plurality of elements that must be assembled to the vehicle's antenna to secure the antenna fob thereto. Alternatively and preferably, some antenna fobs are configured to be secured to antennas by merely pressing the antenna fobs downward onto such antennas.

Regardless of the various types of antenna fobs, several considerations often dictate their design. One consideration is that it is typically desirable to configure the attachment mechanism of an antenna fob in a manner such that the antenna fob will not inadvertently dislodge from a vehicle's antenna during use of the vehicle. Furthermore, it is often desirable to configure the antenna fob in a manner such that it does not spin or rotate relative to the antenna on which it is placed.

SUMMARY OF THE INVENTION

Despite prior art improvements relating to antenna fobs, it is desirable to simplify the manufacture of these devices, and thereby reduce the costs associated therewith. Additionally, it is desirable to improve the ease of attachment of antenna fobs to vehicle antennas, without compromising the performance of such devices. The present invention provides these advantages and has proven to be successful in use.

The antenna fob of the present invention can be formed solely of a polymeric material or rubber-like material and preferably comprises two interlocked parts. The antenna fob is easily attached to a vehicle's antenna merely by inserting the free end of the antenna into a socket formed in the antenna fob. Once this is done, the antenna fob will not easily spin relative to or dislodge from the antenna during normal vehicle use.

In general, the antenna fob of the preferred embodiment comprises a main body portion and a socket. The socket extends into the main body portion and reduces in size as it does so. The socket is dimensioned and is configured and adapted to allow a free end of an antenna of a vehicle to be inserted thereinto. When the free end of the antenna is inserted into the socket, the antenna fob becomes attached to the antenna.

In another aspect of the invention, an antenna fob assembly comprises a hollow exterior body portion and an antenna attachment member. The exterior body portion comprises an interior cavity and at least one opening that extends into the interior cavity. The exterior body portion also comprises an annular channel that encircles its opening. The antenna attachment member comprises a socket that is dimensioned and is configured and adapted to allow a free end of an antenna of a vehicle to be inserted thereinto. Furthermore, the antenna attachment member also comprises an annular rim that encircles the socket and that is engaged with the annular channel of the exterior body portion in a manner such that the socket extends into the interior cavity of the exterior body portion. As such, the antenna attachment member and the exterior body portion are secured to each other via interlocking geometry of the rim and channel.

In yet another aspect of the invention, a method of forming an antenna fob comprising the steps of forming an exterior body portion of an antenna fob, forming an antenna attachment member as a part that is separate from the exterior body portion of the antenna fob, and attaching the antenna attachment member to the exterior body portion of the antenna fob. The forming of the exterior body portion occurs in a manner such that the exterior body portion comprises an annular channel. The forming of the antenna attachment member occurs in a manner such that the antenna attachment member comprises an annular rim. The attachment member is also configured and adapted to secure the exterior portion of the antenna fob to an antenna of a vehicle. Finally, the attaching of the antenna attachment member to the exterior body portion of the antenna fob is achieved by resiliently deflecting at least one of the exterior body portion and the antenna attachment member in a manner such that the rim of the antenna attachment member becomes interlocked with the channel of the exterior body portion.

While the principal advantages and features of the invention have been described above, a more complete and thorough understanding of the invention may be obtained by referring to the drawings and the detailed description of the preferred embodiment which follow.

BRIEF DESCRIPTION OF THE DRAWINGS

Reference characters in the written specification indicate corresponding parts throughout the several views of the drawings.

DETAILED DESCRIPTION OF THE PREFERRED EMBODIMENT OF THE INVENTION

Figure 1:
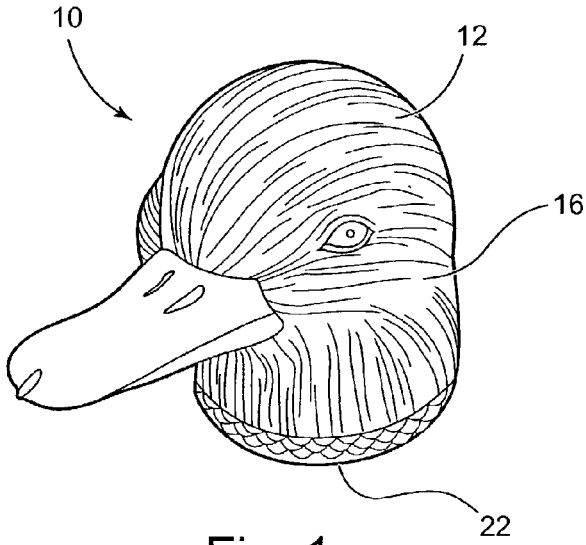
FIG. 1 is a perspective view of the preferred embodiment of the invention, with the particular shape of the exterior thereof being only exemplarily of numerous other shapes.
Figure 2:
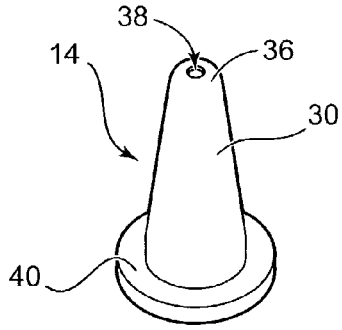
FIG. 2 is a perspective view of the antenna attachment member of the preferred embodiment of the antenna fob of the invention.
Figure 3:
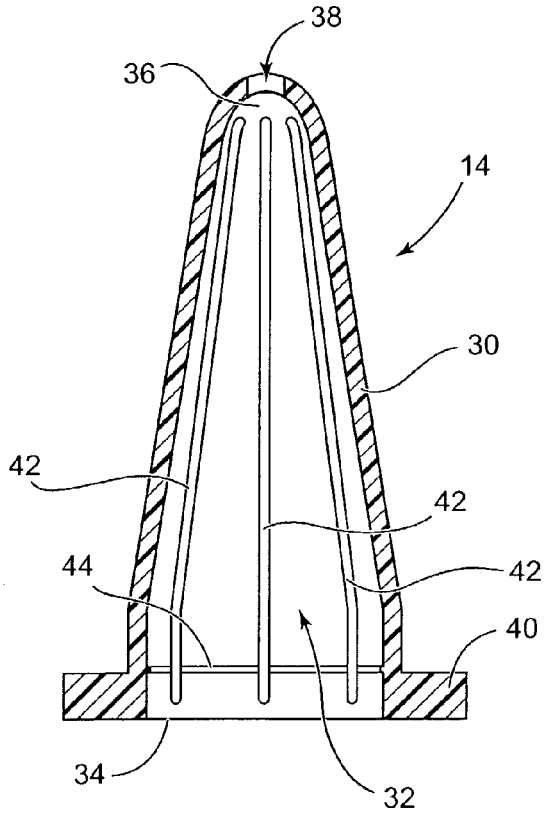
FIG. 3 is a cross-sectional view of the antenna attachment member of FIG. 2, taken about its plane of symmetry.
Figure 4:
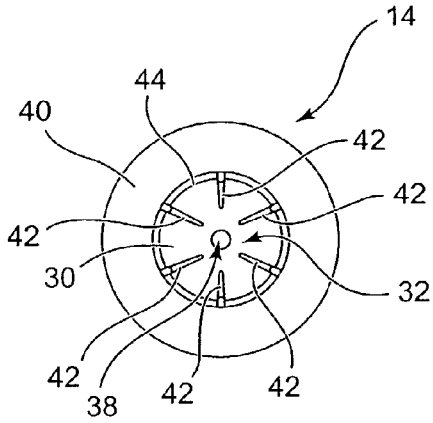
FIG. 4 is a bottom view of the antenna attachment member of FIG. 2.
Figure 5:
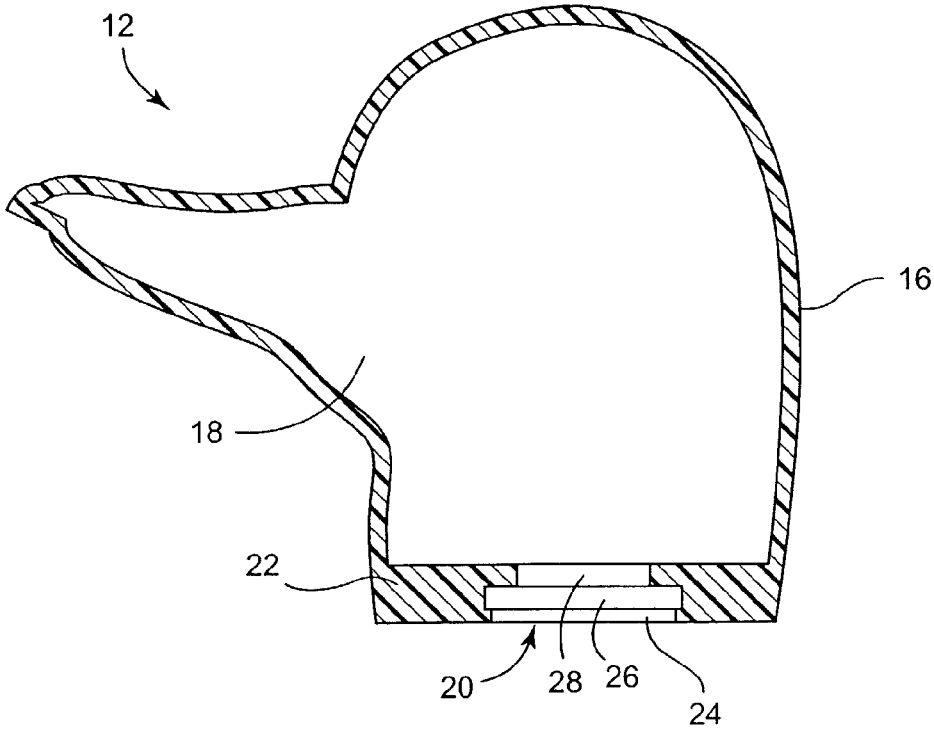
FIG. 5 is a cross-sectional view of the exterior body portion of the preferred embodiment of the antenna fob of the invention.
Figure 6:
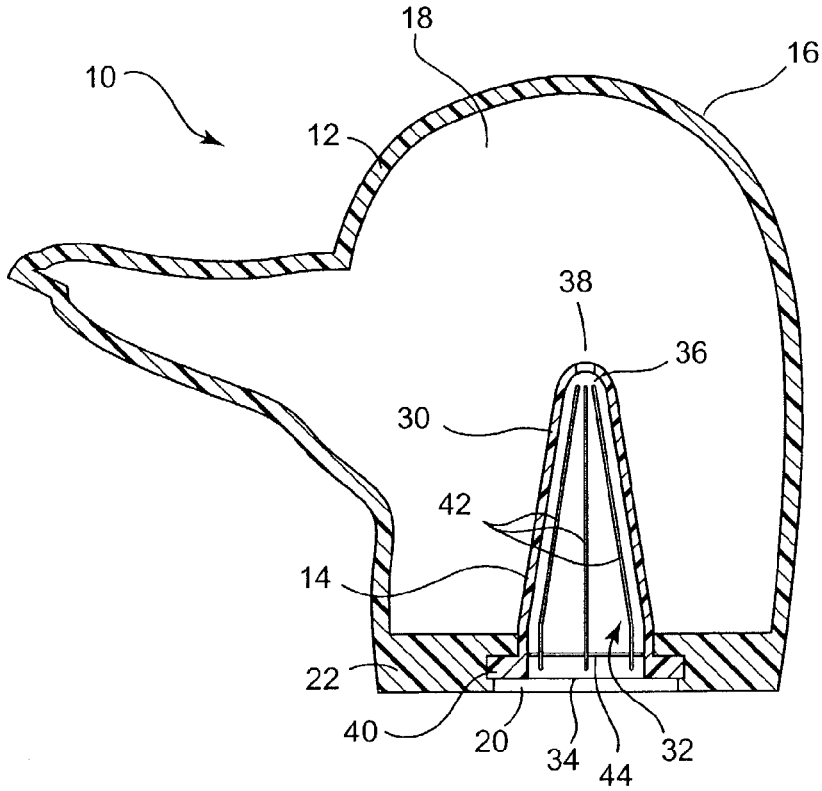
FIG. 6 is a cross-sectional view of the antenna fob of the preferred embodiment of the invention, showing the antenna attachment member interlocked with the exterior body portion of the antenna fob.

The preferred embodiment of the antenna fob 10 of the invention comprises of an exterior body portion 12 and an antenna attachment member 14. The antenna attachment member 14 and the exterior body portion 12 of the antenna fob 10 are preferably formed as separate parts that are interlocked with each other.

The exterior body portion 12 of the preferred embodiment is preferably formed of rubber or plastic and has an outer surface 16 that is shaped to symbolize a particular object or creature, such as the duck as shown. To reduce the weight and material cost of the antenna fob 10, the exterior body portion 12 preferably comprises a hollow interior cavity 18. An opening 20 in the base 22 of the exterior body portion 12 extends into the interior cavity 18.

The opening 20 of the exterior body portion 12 preferably comprises of three coaxial cylindrical portions. The first cylindrical portion 24 has a diameter of less than that of the adjacent second cylindrical portion 26. The third cylindrical portion 28 has a diameter less than that of the first cylindrical portion 24 and is positioned such that the second cylindrical portion 26 lies between the first and third cylindrical portions. Thus, the second cylindrical portion 26 forms an annular channel or groove between the first 24 and third 28 cylindrical portions of the opening 20.

The antenna attachment member 14 of the antenna fob 10 of the preferred embodiment is preferably formed of plastic or rubber that has a lower modulus of elasticity than does the exterior body portion 12. As such, the attachment member 14 is generally more pliable and flexible than is the exterior body portion 12.

The attachment member 14 preferably comprises a thin wall 30 that is shaped to form a socket 32. The thin wall 30 is further shaped such that the socket 32 initially extends cylindrically from its open-end portion 34. The remaining portion of the thin wall 30 then extends toward the opposite terminal end 36 of the socket 32, getting progressively closer to the center axis of the attachment member 14 as it does. This provides the socket 32 with a frustroconical shape adjacent its terminal end 36. An opening 38 extends through the thin wall 30 at the terminal end 36 of the socket 32.

The attachment member 14 of the preferred embodiment also comprises an cylindrical rim 40, a plurality of upwardly extending ribs 42, and an annular rib 44. The cylindrical rim 40 extends from and encircles the thin wall 30 adjacent the open-end portion 34 of the socket 32.

The plurality of ribs 42 are preferably evenly spaced about the center axis of the attachment member 14 and extend upwardly following the contour of the socket 32. Thus, each of the ribs 42 is oriented in a plane that includes the center axis of the attachment member 14. The annular rib 44 is positioned on the cylindrical portion of the socket 32 and is preferably oriented perpendicular to the center axis of the attachment member 14.

The attachment member 14 is preferably assembled to the exterior body portion 12 to form the antenna fob 10 of the preferred embodiment. This is done by inserting the attachment member 14 partially through the opening 20 of the exterior body portion 12 and into the cavity 18, with the terminal end 36 of the socket 32 being inserted first. The cylindrical rim 40 of the attachment member 14 is preferably dimensioned approximately equal to the second cylindrical portion 26 of the opening 20 of the exterior body portion 12. As such, the cylindrical rim 40 of the attachment member 14 will not freely pass through the first cylindrical portion 24 of the opening 20. However, during the assembly of the antenna fob 10, the attachment member 14 is resiliently deformed and forced through the first cylindrical portion 24 of the opening 20. Due to the fact that the third cylindrical portion 28 of the opening 20 has a smaller diameter than that of the first cylindrical portion 24, the attachment member 14 is prevented from also passing through the third cylindrical portion during this procedure.

Once assembled as described above, the cylindrical rim 40 of the attachment member is positioned in the channel created by the second cylindrical portion 26 of the opening 20. As such, the attachment member 14 becomes interlocked with the exterior body portion 12. The attachment member 14 is preferably dimensioned such that there is sufficient friction between the cylindrical rim 40 of the attachment member and the channel formed by the second cylindrical portion 26 of the opening 20 so as to prevent the attachment member 14 from easily rotating relative to the exterior body portion 12.

Figure 7:
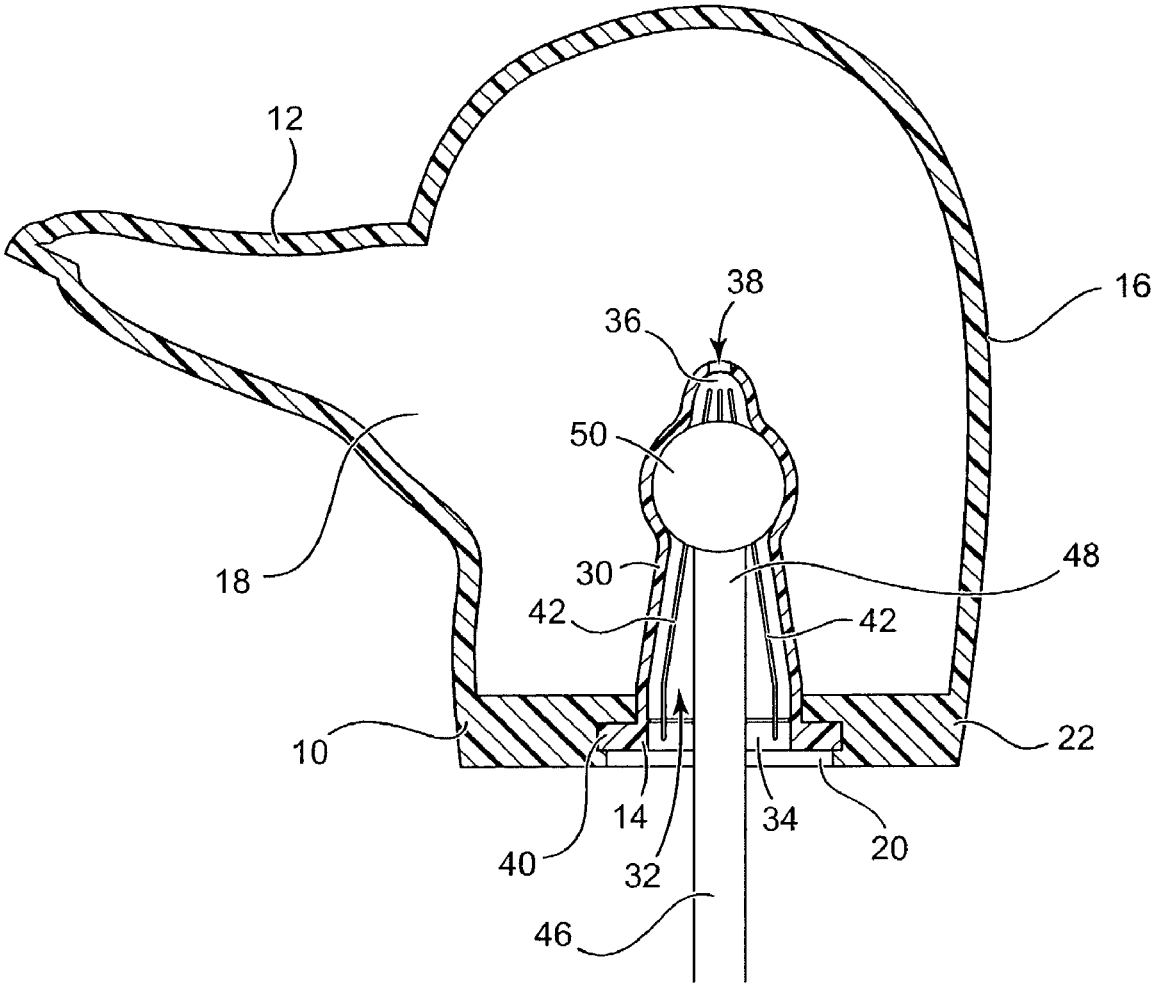
FIG. 7 is a cross-sectional view of the antenna fob of the preferred embodiment of the invention, showing the free end of an antenna inserted in the socket thereof.

Once fully assembled, the antenna fob 10 of the preferred embodiment can be easily attached to a vehicle's antenna 46 by inserting the free end 48 of the antenna into the socket 32 of the attachment member 14 through the open-end portion 34 of the socket. By configuring the socket 32 of the attachment member 14 such that it decreases in size toward its terminal end 36, the tip 50 of the antenna eventually contacts the thin wall 30 that surrounds the socket. This causes the thin wall to resiliently deflect around the tip of the antenna as shown in FIG. 7, which, as a result, improves the attachment member's 14 grip on the antenna 46. During this process, the opening 38 that extends through the thin wall 30 at the terminal end 36 of the socket 32 allows air to escape from the terminal end of the socket to prevent pressure buildup that could potentially impede the process.

When attached to a vehicle's antenna 46 as discussed above, the antenna fob 10 of the preferred embodiment cannot be dislodged from the antenna without a pulling force that is in excess of other forces that the fob would encounter during its use. Additionally, the plurality of ribs 42 engage against the antenna 46 to help prevent the fob from spinning relative to the antenna. Finally, the annular rib 44 of the attachment member 14 provides an additional impediment to the inadvertent removal of the fob from the antenna by providing an obstacle through which the antenna must pass before separating from the fob.

While the present invention has been described in reference to a specific embodiment, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. For example, it should be appreciated that the particular shape of the main body portion is not limited to a symbol of a duck's head and that countless other shapes could be used alternatively. Additionally, while the preferred embodiment of the invention pertains to an antenna fob constructed of two pieces, the claims should be interpreted as being so limited unless literally requiring such.

Furthermore, it should be understood that when introducing elements of the present invention in the claims or in the above description of the preferred embodiment(s) of the invention, the terms "comprising," "including," and "having" are intended to be inclusive and mean that there may be additional elements other than the listed elements.

What is claimed is:

1. An assembly comprising:

an antenna comprising a free end; and an antenna fob attached to the free end of the antenna, the antenna fob comprising a main body and a socket, the socket extending into the main body and reducing in size as it extends into the main body, the socket being dimensioned and being configured and adapted to allow the free end of the antenna to be inserted thereinto, the socket comprising an annular rim that encircles the socket, the main body comprising an annular channel and an interior cavity, the annular rim of the socket being engaged with the annular channel of the main body in a manner such that the socket extends into the interior cavity of the main body and in a manner such that the socket and the main body are secured to each other via interlocking geometry of the rim and channel, the socket having an open end portion and an opposite terminal end portion, the open end portion being configured and adapted to allow the free end of the antenna to pass therethrough and the terminal end portion being configured and adapted to prevent the free end of the antenna from passing therethrough.

2. An assembly in accordance with claim 1 wherein the socket of the antenna fob extends into the main body along an axis, the socket comprising at least one rib that protrudes toward the axis and that extends along a path that lies in a plane that includes the axis.

3. An assembly in accordance with claim 1 wherein the socket of the antenna fob extends into the main body along an axis, the socket comprising at least one annular rib that encircles and protrudes toward the axis.

4. An assembly in accordance with claim 1 wherein the socket of the antenna fob is at least partially bound by a thin wall of material that is resiliently deformed around the free end of the antenna.

5. An assembly in accordance with claim 1, wherein the terminal end portion of the socket is defined by the thin wall of material and comprises an opening that extends through the thin wall, the opening being configured and adapted to allow air to pass therethrough.

6. An assembly in accordance with claim 1, wherein the terminal end portion of the socket is defined by the thin wall of material and the socket extends into the main body along an axis, the socket comprising at least one rib that protrudes toward the axis from the thin wall and that extends along a path that lies in a plane that includes the axis.

7. An assembly in accordance with claim 1 wherein at least a portion of the socket of the antenna fob is dimensioned and shaped in a form of a frustrum.

8. An antenna fob assembly comprising a hollow exterior body portion and an antenna attachment member, the exterior body portion comprising an interior cavity and at least one opening that extends into the interior cavity, the exterior body portion also comprising an annular channel that encircles the opening, the antenna attachment member comprising a socket that is dimensioned and is configured and adapted to allow a free end of an antenna of a vehicle to be inserted thereinto, the antenna attachment member also comprising an annular rim that encircles the socket and that is engaged with the annular channel of the exterior body portion in a manner such that the socket extends into the interior cavity of the exterior body portion and in a manner such that the antenna attachment member and the exterior body portion are secured to each other via interlocking geometry of the rim and channel, the socket having an open end portion and an opposite terminal end portion, the open end portion being configured and adapted to allow the free end of the antenna to pass therethrough and the terminal end portion being configured and adapted to prevent the free end of the antenna from passing therethrough.

9. An antenna fob assembly in accordance with claim 8 wherein the socket reduces in size as it extends into the interior cavity of the exterior body portion.

10. An antenna fob assembly in accordance with claim 8 wherein the socket extends into the interior cavity along an axis, the socket comprising at least one rib that protrudes toward the axis and that extends along a path that lies in a plane that includes the axis.

11. An antenna fob assembly in accordance with claim 8 wherein the socket is at least partially bound by a thin wall of material that is adapted and configured to resiliently deform around the free end of the antenna when the free end of the antenna is inserted into the socket.

12. An antenna fob assembly in accordance with claim 11 wherein the terminal end portion of the socket is defined by the thin wall of material and has an opening that extends through the thin wall, the opening being configured and adapted to allow air to escape out of the socket as the free end of the antenna is inserted into the socket.

13. An antenna fob assembly in accordance with claim 12 wherein the socket extends into the main body portion along an axis, the socket comprising at least one rib that protrudes toward the axis from the thin wall and that extends along a path that lies in a plane that includes the axis.

14. An antenna fob assembly in accordance with claim 9 wherein the socket is at least partially bound by a thin wall of material that is adapted and configured to resiliently deform around the free end of the antenna when the free end of the antenna is inserted into the socket.

15. An assembly comprising an antenna fob assembly in accordance with claim 8 and an antenna, the antenna comprising a free end that is positioned inside of the socket of the antenna attachment member, the socket and the free end of the antenna being engaged with each other in a manner such that the antenna fob assembly is secured to the antenna.

16. A method of forming an antenna fob comprising the steps of:

forming an exterior body portion of an antenna fob, the forming of the exterior body portion occurring in a manner such that the exterior body portion comprises an annular channel;

forming an antenna attachment member as a part that is separate from the exterior body portion of the antenna fob, the attachment member being configured and adapted to secure the exterior portion of the antenna fob to an antenna of a vehicle, the forming of the antenna attachment member occurring in a manner such that the antenna attachment member comprises an annular rim; and attaching the antenna attachment member to the exterior body portion of the antenna fob by resiliently deflecting at least one of the exterior body portion and the antenna attachment member in a manner such that the rim of the antenna attachment member becomes interlocked with the channel of the exterior body portion.

17. The method of claim 16 wherein the steps of forming the exterior body portion of the antenna fob and forming the antenna attachment member comprises forming the antenna attachment member and the exterior body portion from different materials such that the antenna attachment member has a lower modulus of elasticity than does the exterior body portion.

* * * * *